US006347996B1

(12) United States Patent
Gilmore et al.

(10) Patent No.: US 6,347,996 B1
(45) Date of Patent: Feb. 19, 2002

(54) GAMING MACHINE WITH CONCEALED IMAGE BONUS FEATURE

(75) Inventors: Jason C. Gilmore, Bartlett; Michael P. Casey, Chicago, both of IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/660,106

(22) Filed: Sep. 12, 2000

(51) Int. Cl.[7] ..... A63F 3/00

(52) U.S. Cl. ..... 463/17; 463/20; 463/21; 273/139

(58) Field of Search ..... 273/139, 242, 273/243, 236, 237; 463/17, 16, 20

(56) References Cited

U.S. PATENT DOCUMENTS

| | | | | |
|---|---|---|---|---|
| 5,056,793 A | * 10/1991 | Sigle | 273/282 |
| 5,123,658 A | * 6/1992 | Elfanbaum | 273/430 |
| 5,221,094 A | * 6/1993 | Hanson | 273/431 |
| 5,288,075 A | * 2/1994 | Kelley | 273/243 |
| 5,855,514 A | * 1/1999 | Kamille | 463/17 |
| 5,931,467 A | * 8/1999 | Kamille | 273/139 |
| 5,996,997 A | * 12/1999 | Kamille | 273/139 |
| 6,015,346 A | 1/2000 | Bennett | |
| 6,089,976 A | 7/2000 | Schneider et al. | |

FOREIGN PATENT DOCUMENTS

| | | |
|---|---|---|
| GB | 2231189 | * 7/1990 |
| GB | 2271262 | * 6/1994 |
| WO | WO 97/34671 | * 9/1997 |

OTHER PUBLICATIONS

Product Sheet; "Instant Winner," WMS Gaming Inc., Chicago, Illinois, 1999.
Product Sheet; "Keep Your Hat On," Aristocrat Technologies, Inc., 2000.
Product Sheet; "Jackpot Party Video 9–Line," WMS Gaming Inc., Chicago, Illinois, 1999.

* cited by examiner

*Primary Examiner*—Michael O'Neill
*Assistant Examiner*—Yveste G. Cherubin
(74) *Attorney, Agent, or Firm*—Jenkens & Gilchrist

(57) ABSTRACT

A gaming machine controlled by a processor in response to a wager, comprises a basic game and a bonus feature. The basic game includes a plurality of basic game outcomes. The plurality of basic game outcomes include a start-bonus outcome. The bonus feature is triggered by the start-bonus outcome and indicated on a visual display. The bonus feature includes a selection stage succeeded by a bonus stage. In the selection stage, the visual display initially depicts an assemblage of selectable elements that conceal a unified image. The elements are successively selected by the player and/or processor to generate bonus-opportunity outcomes until an element is selected that produces a stop-selection outcome. The elements associated with each bonus-opportunity outcome are removed from the assemblage to reveal those portions of the unified image concealed by those elements. In response to the stop-selection outcome, the bonus feature proceeds to the bonus stage. In the bonus stage, each bonus-opportunity outcome generated in the selection stage earns the player an opportunity to win a respective bonus in the bonus stage.

20 Claims, 5 Drawing Sheets

GAMING MACHINE WITH CONCEALED IMAGE BONUS FEATURE

FIELD OF THE INVENTION

The present invention relates generally to gaming machines and, more particularly, to a gaming machine including a concealed image bonus feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features for bonus games to satisfy the demands of players and operators. Preferably, such new bonus game features will maintain, or even further enhance, the level of player excitement offered by bonus games heretofore known in the art. The present invention is directed to satisfying these needs.

SUMMARY OF THE INVENTION

A gaming machine controlled by a processor in response to a wager, comprises a special feature indicated on a visual display. The visual display initially depicts an assemblage of selectable elements that conceal a unified image. The elements are successively selected and selectively removed from the assemblage in groups based on predetermined criteria to reveal part of the unified image. The special feature awards a bonus based on the selective removal of the selected elements.

BRIEF DESCRIPTION OF THE DRAWINGS

The foregoing and other advantages of the invention will become apparent upon reading the following detailed description and upon reference to the drawings in which.

Figure 1:
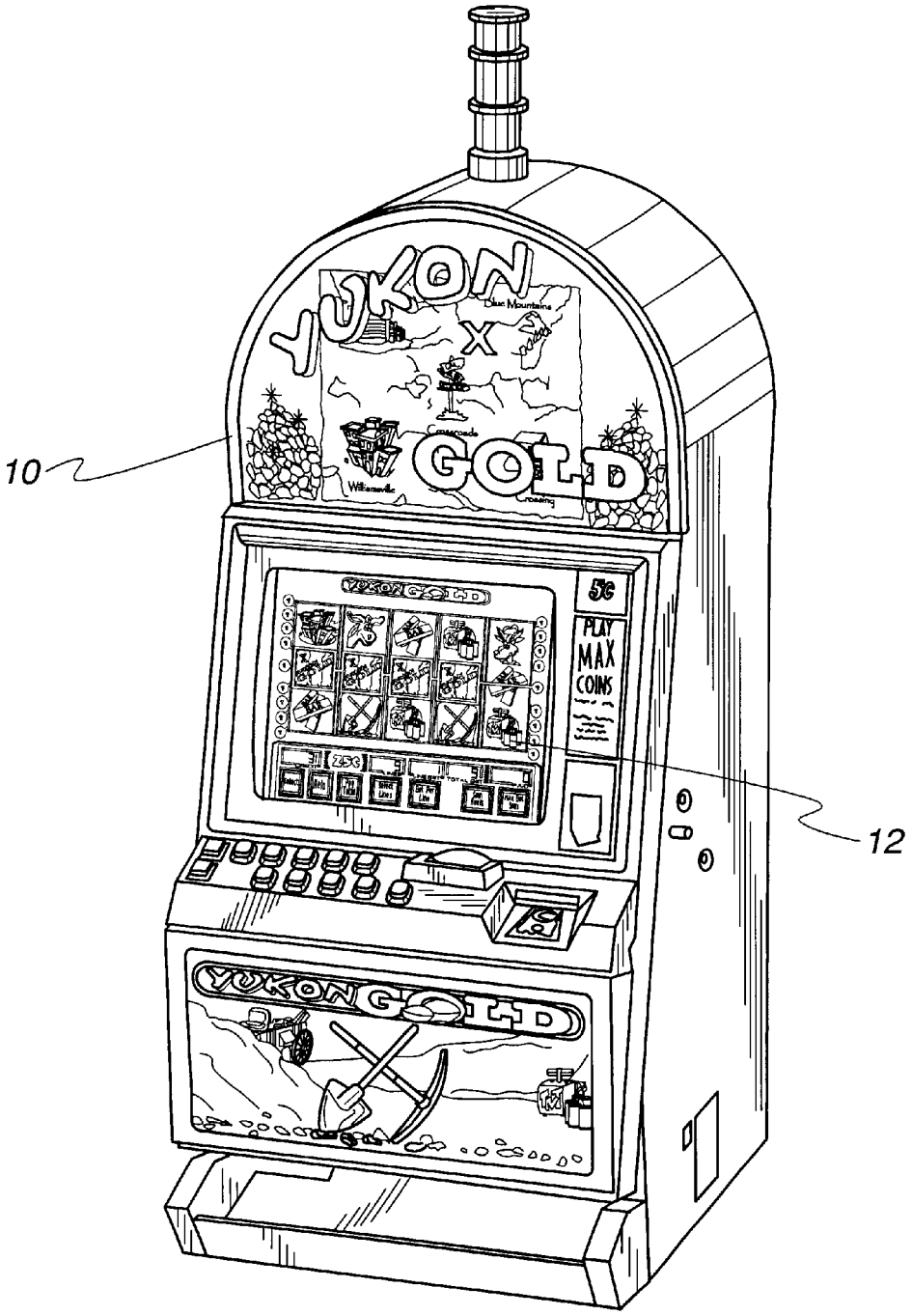
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a gaming machine 10 that may be used to implement a bonus game according to the present invention. The gaming machine 10 includes a video display 12 preferably in the form of a dot matrix, CRT, LED, LCD, electro-luminescent, or other type of video display known in the art. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player. The video display 12 is preferably outfitted with a touch screen to facilitate interaction between the player and aspects of the game of chance played on the machine.

In one embodiment, the gaming machine 10 is operable to play a game of chance entitled YUKON GOLD™ having an 1849 gold rush theme. The YUKON GOLD™ game features a basic slot game with five simulated spinning reels and a concealed image interactive bonus game discussed in detail below. It will be appreciated, however, that the gaming machine 10 may be implemented with any of several alternative game themes.

Figure 2:
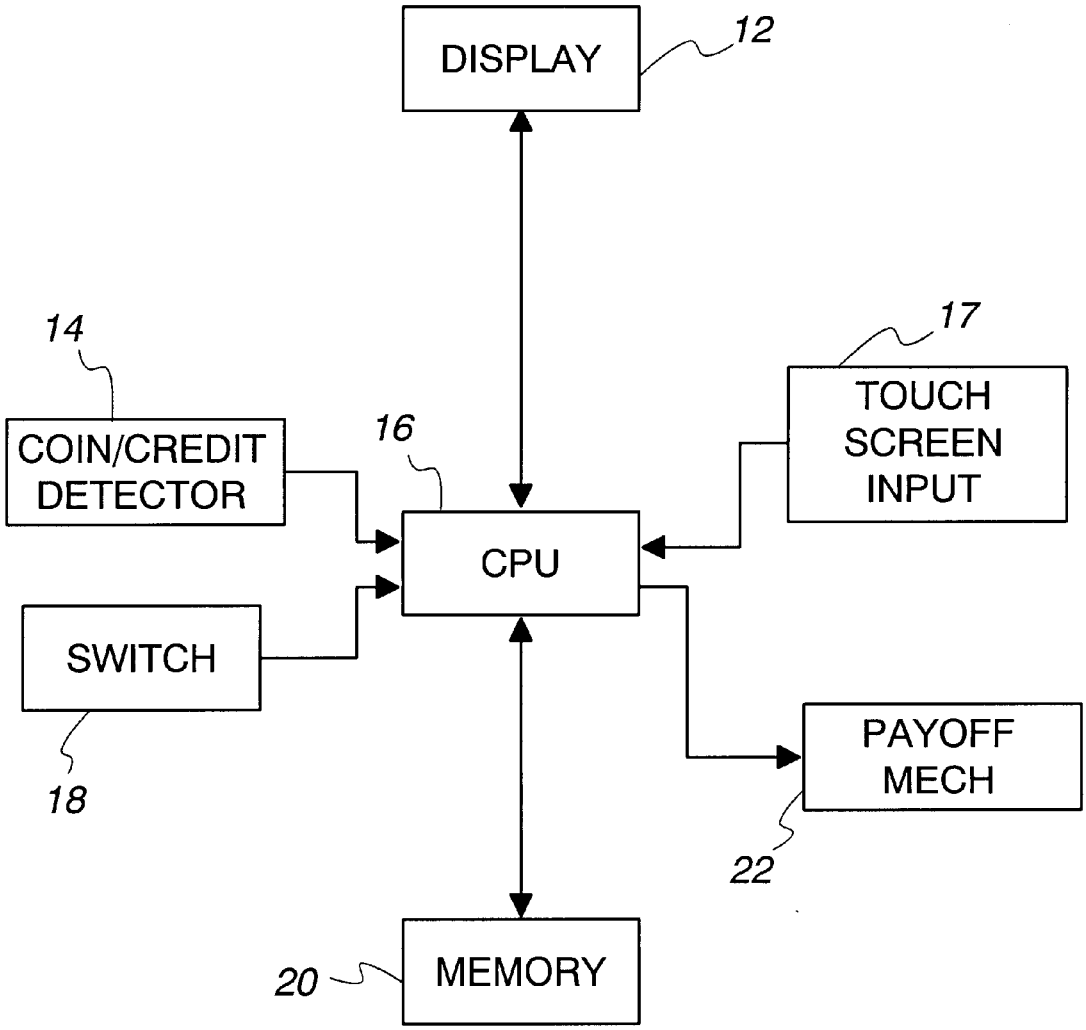
FIG. 2 is a block diagram of a control system suitable for operating the gaming machine.

FIG. 2 is a block diagram of a control system suitable for operating the gaming machine 10. Coin/credit detector 14 signals a central processing unit (CPU) 16 when a player has inserted a number of coins or played a number of credits. Then, the CPU 16 operates to execute a game program that causes the video display 12 to display the basic game that includes simulated symbol-bearing reels. The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome and then stop the reels to display symbols corresponding to the pre-selected game outcome. In one embodiment, certain of the basic game outcomes cause the CPU 16 to enter a bonus mode causing the display 12 to show the concealed image interactive bonus game.

A system memory 20 stores control software, operational instructions and data associated with the gaming machine 10. In one embodiment, the memory 20 comprises a separate read-only memory (ROM) and battery-backed random-access memory (RAM). However, it will be appreciated that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which might occur in the basic game or bonus game. The payoff amounts corresponding to certain combinations of symbols in the basic game is predetermined according to a pay table stored in system memory 20. The payoff amounts corresponding to certain outcomes of the bonus game are also stored in system memory 20.

Figure 3:
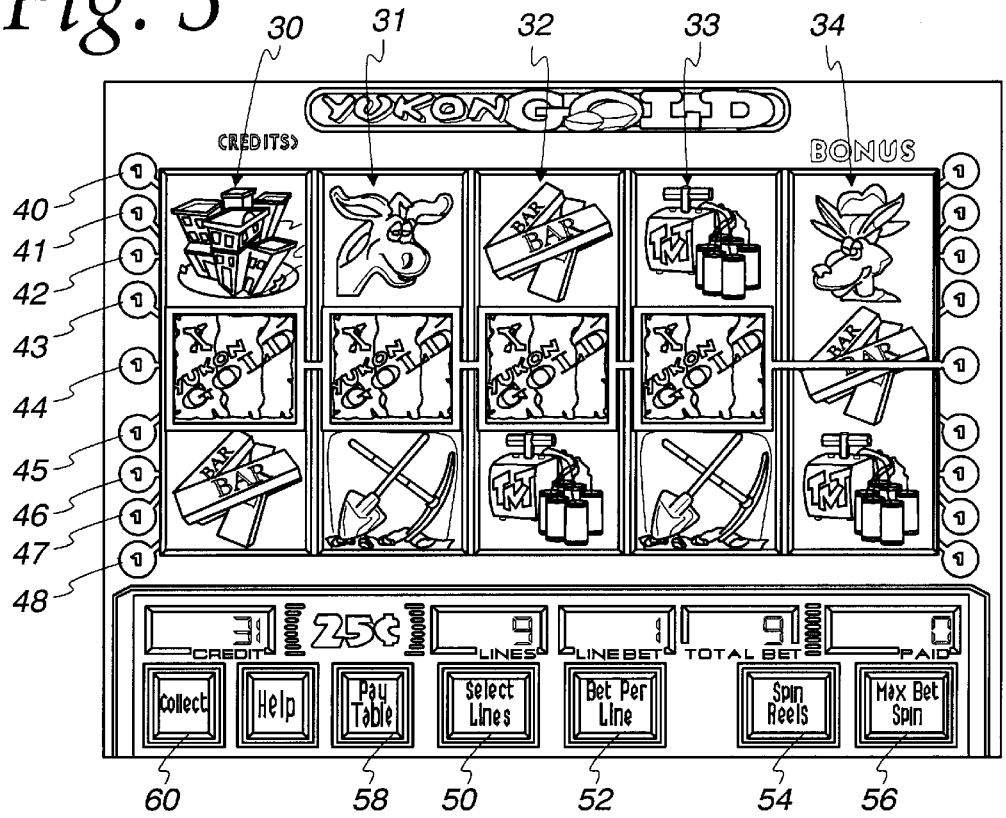
FIG. 3 is a display screen capture showing simulated reels of a five-reel, nine-line basic game played on the gaming machine.

As shown in FIG. 3, the basic game is implemented on the video display 12 on five video simulated spinning reels 30, 31, 32, 33 and 34 (hereinafter "reels") with nine pay lines 40–48. Each of the pay lines 40–48 extends through one symbol on each of the five reels 30–34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30–34 to stop at the appropriate stop position. Video symbols are displayed on the reels 30–34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 60.

The reel symbols for the YUKON GOLD™ basic game include a YUKON GOLD logo, Gold Nuggets, Sammy the Miner, Biff the Gold Swindler, Vanessa the Barmaid, Jack the Donkey, Wagon, Dynamite, Pick Axe and Shovel, Town, Triple Bar Symbol, 7 Symbol, and a Wild symbol. In a preferred implementation, the winning combinations start from the first reel 30 (left to right) and span adjacent reels. In an alternative implementation, the winning combinations start from either the first reel 30 (left to right) or the fifth reel 34 (right to left) and span adjacent reels. Except for the YUKON GOLD logo and Wagon, three or more of the same symbol generate a basic game payout. The Wild symbol is wild for all symbols except for the YUKON GOLD logo and the Wagon.

Figure 4:
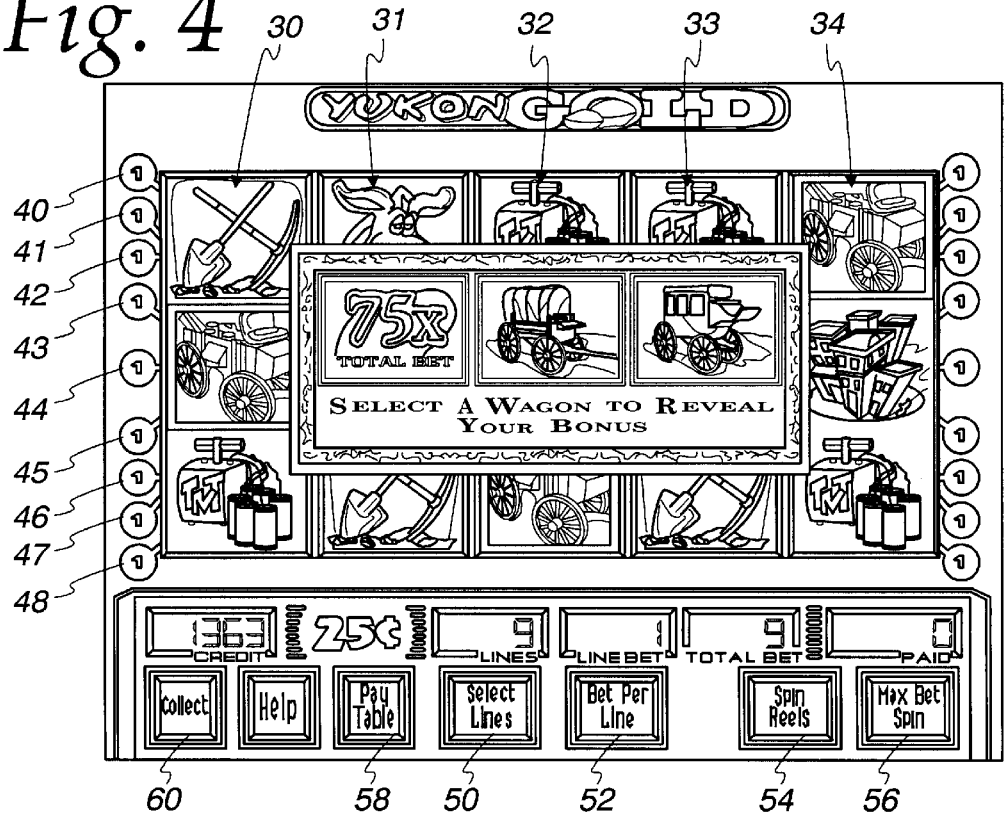
FIG. 4 is a display screen capture showing a "Chuck Wagon" bonus feature.

Referring to FIG. 4, during the basic game, a random "Chuck Wagon" bonus occurs when the reels spin and stop with two or three Wagon reel symbols in any displayed position on the reels. In FIG. 4, for example, the reels stopped with a first Wagon symbol in the middle row of reel 30, a second Wagon symbol in the bottom row of reel 32, and third Wagon symbol in the top row of reel 34. A chuck wagon stampede sound plays (whips cracking, the occasional "Yeaaaah!" horses galloping, etc.), clueing the player that the "Chuck Wagon" bonus is about to begin. The player then selects between three different wagons that appear as a pop-up in front of the reels. Doing so initiates a small animation that visually dissolves the wagon to reveal a bonus in the form of a multiplier of 3, 5, or 7 times the player's total bet for two Wagon symbols triggering the "Chuck Wagon" bonus and of 50, 75, or 100 times the player's total bet for three Wagon symbols triggering the "Chuck Wagon" bonus.

Referring back to FIG. 3, lining up three or more YUKON GOLD logos on an active pay line triggers the concealed image bonus feature. In FIG. 3, for example, four YUKON GOLD logos are displayed along the horizontal pay line 44.

Figure 5:
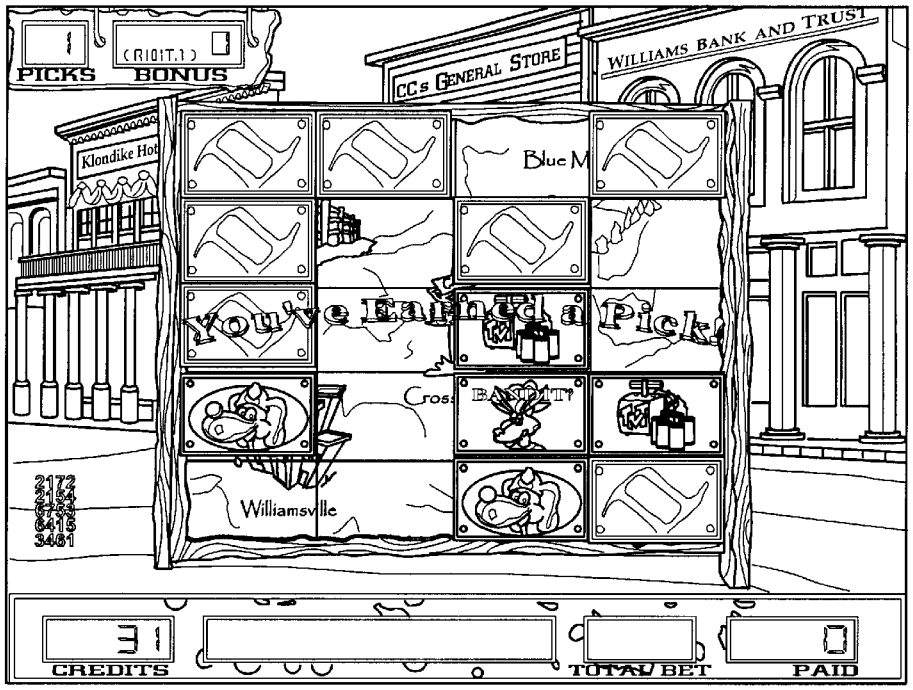
FIGS. 5, 6, and 7 are display screen captures showing a concealed image bonus feature.

Referring to FIG. 5, the bonus feature includes a selection stage succeeded by a bonus stage. In the selection stage, the visual display (under control of the CPU) initially depicts a matrix of twenty selectable tiles or squares on a billboard in the center of the screen, with the surrounding outside area for game characters, environment, a "picks" meter, and a "bonus" meter. Each tile is associated with a hidden reel symbol icon. Using the touch screen, the player then touches a tile to reveal a reel symbol icon that the player has to match. One way for the player to accomplish this match is by selecting two other tiles associated with the same reel symbol icon. As shown in FIG. 5, selecting three tiles with the same reel symbol icon removes the three matching tiles from the billboard, revealing part of a mining map beneath the tiles and adding a pick to the picks meter. A pick is rewarded each time three matching tiles are selected. During the selection stage, if the player delays in selecting a tile for more than a predetermined period of time, the CPU will randomly make the next selection for the player to prevent the game from remaining idle for too long.

Figure 6:
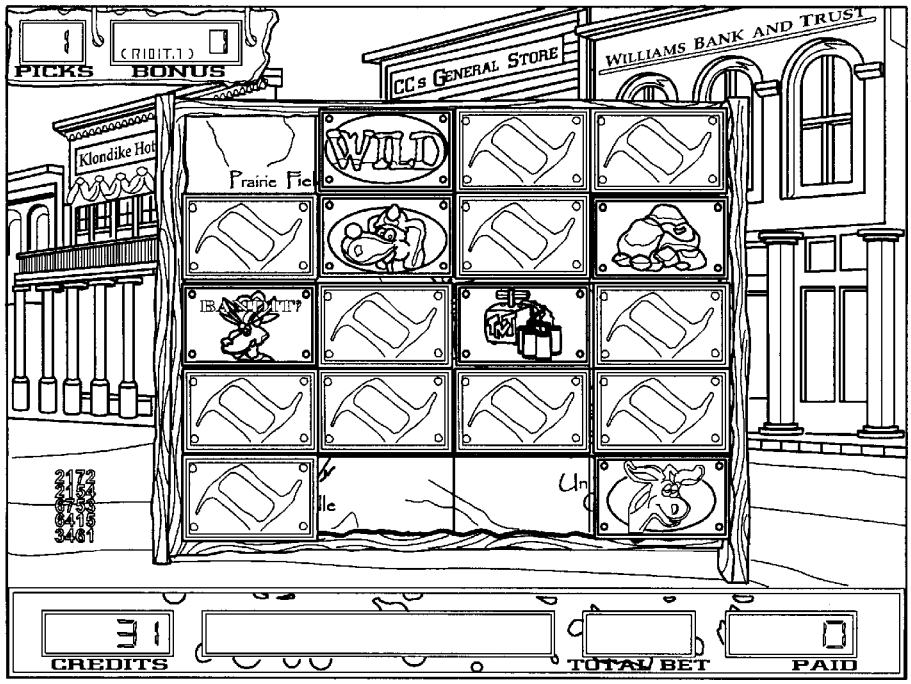

Referring to FIG. 6, the other way for the player to accomplish a match during the selection stage is for the player to select a "Wild" tile. In a preferred embodiment, one of the twenty tiles are "Wild." Selecting this tile automatically creates a match to an existing pair of matching tiles that have already had their reel symbol icons revealed. Not only does the "Wild" tile provide a generic match, but it also automatically selects the third matching tile. Therefore, the player is essentially getting two tiles for the selection of one "Wild" tile. All four tiles, i.e., the "Wild" tile and the three matching tiles with the same reel symbol icon, then disappear and reveal part of the mining map beneath the tiles. If, as in FIG. 6, the "Wild" tile is selected and there are no existing pairs of matching tiles at the time of its selection, the "Wild" tile remains on the billboard until a pair of matching tiles is selected and can be matched with the third tile of its group by using the "Wild" tile.

The selection stage continues until three of four tiles with Bandit! symbols are selected. The "Wild" tile does not match the Bandit! selections. Once three Bandit! tiles have been selected, all remaining tiles are removed from the playing board to reveal the entire mining map and the bonus feature proceeds to the bonus stage. If a player selects three Bandit! tiles with no other matches, the bonus feature ends and the player is awarded a nominal bonus ranging from 10 to 200 times the player's line bet.

Figure 7:
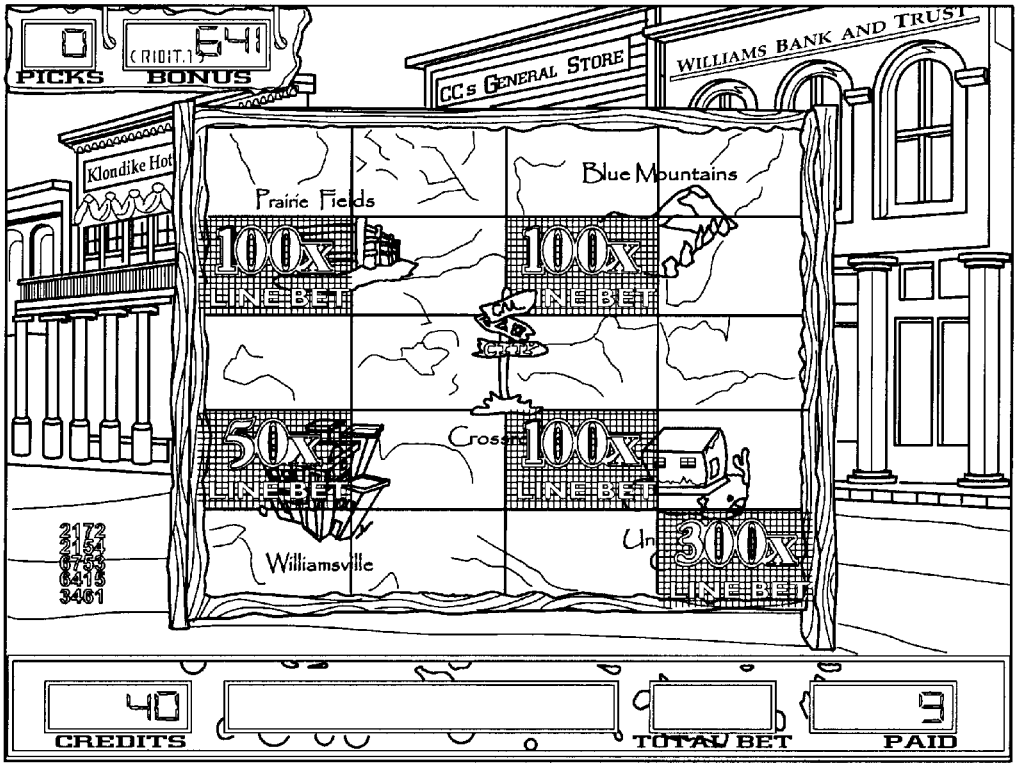

The game allows the player to mine for gold at a number of spots corresponding to the number on the "picks" meter. Therefore, if a player selects X matches, the game will allow the player to mine for gold at X spots on the mining map. The player does this by simply touching on the map where the player wants to dig. Selecting a spot on the map reveals a bonus for that selection. Players can have as few as zero selections (by selecting three Bandit! tiles and no matches in the selection stage) and as many as five selections (by correctly getting all of the matches in the selection stage) on the mining map. In FIG. 7, for example, the player had five selections and was awarded respective bonuses of 50 times the line bet, 100 times the line bet, 100 times the line bet, 100 times the line bet, and 300 times the line bet. The average pick value increases with the number of YUKON GOLD logos that trigger the bonus feature. At the end of the bonus stage, play returns to the basic game.

While the present invention has been described with reference to one or more particular embodiments, those skilled in the art will recognize that many changes may be made thereto without departing from the spirit and scope of the present invention. For example, the basic game need not comprise a spinning reel slot machine game as illustrated in FIG. 1, but may comprise virtually any type of game of chance or skill or combination of games having outcomes (e.g., start-bonus outcomes) that trigger play of a bonus game on one or more displays. For example, the basic game may comprise a video poker or blackjack game. Also, the YUKON GOLD™ bonus feature may be implemented as a stand-alone basic game that is not triggered by start-bonus outcomes on spinning reels. In the bonus feature, the number, shape, and arrangement of tiles may be varied. A match may be defined to include two or more matching tiles, and the matching tiles may be associated with similar or dissimilar indicia that are predefined to form a match. Instead of awarding bonuses based on the number of tile matches removed from the board, the bonus feature could award bonuses based on which tiles are removed from the board. For instance, the bonus feature could award a bonus for a particular mining spot on the mining map only if that mining spot is revealed upon removal of one of the matches. Each of these embodiments and obvious variations thereof is contemplated as falling within the spirit and scope of the claimed invention, which is set forth in the following claims.

What is claimed is:

1. A gaming machine controlled by a processor in response to a wager, comprising a special feature indicated on a visual display, the visual display initially depicting an assemblage of selectable elements that conceal a unified image, the elements being successively selected and being selectively removed from the assemblage based on predetermined criteria to reveal part of the unified image, the special feature awarding bonus opportunities based upon a number of the selected elements removed from the assemblage.

2. The gaming machine of claim 1, further including a basic game including a plurality of basic game outcomes, the plurality of basic game outcomes including a start-feature outcome, the special feature being triggered by the start-feature outcome.

3. The gaming machine of claim 1, wherein the visual display is a video display.

4. The gaming machine of claim 1, wherein the selectable elements are associated with respective symbols that are revealed upon selection, the selected elements removed from the assemblage being associated with symbols that form one or more matches.

5. The gaming machine of claim 1, wherein the special feature awards a bonus based upon the number of the selected elements removed from the assemblage.

6. The gaming machine of claim 1, wherein the assemblage is arranged as a matrix.

7. The gaming machine of claim 1, wherein the selected elements removed from the assemblage are grouped into one or more matches, each match yielding a respective one of the bonus opportunities.

8. The gaming machine of claim 1, wherein the selected elements are selectively removed from the assemblage in groups.

9. The gaming machine of claim 8, wherein each group includes matching ones of the selected elements.

10. The gaming machine of claim 8, wherein each group yields a respective one of the bonus opportunities.

11. A special feature for a gaming machine controlled by a processor in response to a wager, the special feature being indicated on a visual display, the special feature comprising:

a selection stage including an assemblage of selectable elements that conceal a unified image, the elements being successively selected to generate bonus-opportunity outcomes until an element is selected that produces a stop-selection outcome, the elements associated with each bonus-opportunity outcome being removed from the assemblage to reveal those portions of the unified image concealed by those elements; and a bonus stage triggered by the stop-selection outcome, each bonus-opportunity outcome generated in the selection stage earning the player an opportunity to win a respective bonus in the bonus stage.

12. The special feature of claim 11, wherein the elements associated with each bonus-opportunity outcome are linked with matching symbols of a first type, while the elements associated with the stop-selection outcome are linked with matching symbols of a second type.

13. The special feature of claim 11, wherein the bonus stage is comprised of a plurality of selectable bonus-generating elements indicated on the unified image, the unified image being completely revealed for the bonus stage, each bonus-opportunity outcome generated in the selection stage earning a corresponding selection of one of the bonus-generating elements.

14. The special feature of claim 11, wherein the visual display is a video display.

15. The special feature of claim 11, wherein the elements associated with each bonus-opportunity outcome are associated with matching symbols.

16. A gaming machine controlled by a processor in response to a wager, comprising a special feature indicated on a visual display, the visual display initially depicting an assemblage of selectable elements that conceal a unified image, the elements being successively selected and being selectively removed from the assemblage in groups based on predetermined criteria to reveal part of the unified image, the special feature awarding a bonus based on the selective removal of the selected elements.

17. The gaming machine of claim 16, wherein each group includes matching ones of the selected elements.

18. A method of operating a gaming machine, comprising:

receiving a wager;

indicating, under control of a processor, a special feature of chance on a visual display, the visual display initially depicting an assemblage of selectable elements that conceal a unified image;

receiving successive selections of the elements;

selectively removing the selected elements from the assemblage based on predetermined criteria to reveal part of the unified image; and awarding a bonus based on the selective removal of the selected elements.

19. The method of claim 18, wherein the selected elements are selectively removed from the assemblage in groups.

20. The method of claim 19, wherein each group includes matching ones of the selected elements.

* * * * *